United States Patent [19]

Perlman

[11] Patent Number: 4,933,148

[45] Date of Patent: Jun. 12, 1990

[54] PIPETTER BARREL EXTENSION TUBE

[75] Inventor: Daniel Perlman, Arlington, Mass.

[73] Assignee: Brandeis University, Waltham, Mass.

[21] Appl. No.: 228,290

[22] Filed: Aug. 4, 1988

[51] Int. Cl.[5] ..... B01L 3/02

[52] U.S. Cl. ..... 422/100; 422/101; 73/864.11; 73/864.13; 73/864.14

[58] Field of Search ..... 73/864.01, 864.14, 864.15, 73/864.13, 864.17, 864.23, 865.11; 422/100, 101; 222/567; 138/40, 41, 42; 604/207, 229

[56] References Cited

U.S. PATENT DOCUMENTS

| | | | |
|---|---|---|---|
| 2,515,956 | 7/1950 | Greenberg | 604/207 |
| 3,814,079 | 6/1974 | Le Roy, Sr. | 210/359 |
| 3,873,449 | 3/1975 | Connelly et al. | 210/359 |
| 3,982,899 | 9/1976 | Kelm | 73/864.18 |
| 4,178,803 | 12/1979 | Lee | 73/864.13 |
| 4,212,204 | 7/1980 | St. Amand | 73/864.11 |
| 4,362,064 | 12/1982 | Marteau d'Autry | 73/864.13 |
| 4,384,581 | 5/1983 | Conway | 604/207 |
| 4,671,123 | 6/1987 | Magnussen, Jr. et al. | 73/864.14 |
| 4,707,337 | 11/1987 | Jeffs et al. | 73/864.01 |
| 4,767,415 | 9/1988 | Duffy | 128/655 |

*Primary Examiner*—Christine M. Nucker
*Assistant Examiner*—Gregory R. Muir
*Attorney, Agent, or Firm*—Lorusso & Loud

[57] ABSTRACT

A pipetter barrel extension tube, attachable at its proximal end to any one of a variety of pipetter barrels and at its distal end to standard disposable pipetter tips. The pipetter barrel extension tube serves to extend the length of the barrels and provide sterile access to deep containers while substantially isolating the permanent barrel of the micropipet from damage caused by chemical and radiochemical contamination. One novel design feature of the extension tube is an air channel designed to minimize dead air volume in the extension tube. A removable conical insert plug serves to reduce the air channel volume. Removal of the plug facilitites cleaning and reuse of the extension tube. The device also includes a distal end segment which, when intact, serves as a space-filler to reduce dead air volume in disposable tips for pipetting small volumes. When the segment is removed, the extension tube still attaches to the same disposable tips but allows larger volumes of liquid into these tips as required for larger capacity pipetting devices.

16 Claims, 2 Drawing Sheets

PIPETTER BARREL EXTENSION TUBE

FIELD OF THE INVENTION

The present invention generally relates to a device for extending the length of a laboratory pipetting instrument. More particularly the invention relates to a pipetter barrel extension tube of which one end can be attached to a variety of commercial pipetter instruments while the other end can be attached to liquid-dispensing disposable plastic tips.

BACKGROUND OF THE INVENTION

Laboratory pipetter instruments are typically manual or semi-automatic devices designed to accurately and reproducibly despense small liquid volumes typically less than 1 milliliter (ml). These devices are usually elongated instruments which, from top to bottom, typically consist of a finger activated plunger or button at the top, a hand grip in the middle, and a barrel at the bottom. The finger-activated plunger or button initiates withdrawal and dispensing of liquid. The hand grip usually houses a digital mechanism for adjusting delivery volume. The barrel houses a volumetric piston of which the distance of travel directly determines the volume of liquid delivered from the instrument. An easily removable disposable plastic tip which holds the liquid entering or exiting the pipetter is attached to the end of the pipetter barrel. This tip, typically fabricated from polyethylene or polypropylene, is clean and often sterile, and should not allow liquid to enter and contaminate the barrel containing the volumetric piston and other inner workings of the pipetter.

Occasionally during rapid pipetting operations or those involving volumes approaching the capacity of the disposable tip, liquid may be projected upward through the tip, contaminating the barrel. Depending on the application for which the pipetter is used, chemical, radiochemical, and biological contamination on both the inside and outside of the barrel may result. Contamination on the outside of the barrel is especially likely to occur during removal and dispensing of liquids from flasks, necked bottles, or test tubes. The subsequent accuracy and the ability to maintain sterility during liquid transfers may be compromised by such contamination.

Often it is desirable to remove or to deposit small volumes of liquid within deep containers, though presently available pipetters have a limited capability for reaching the bottom of such containers. The current practice is to either tilt a deep container to bring liquid near the container's orifice for pipetting of first transfer a sample of liquid to a shallow vessel using a long transfer pipet and to subsequently employ the accurate pipetter. These awkward or indirect pipetting operations are typically less desirable and less convenient than the one step pipetting operation that results when using the present invention. Further, only the short disposable tip of most pipetter instruments can be easily sterilized, leaving the remainder of the pipetter contaminated.

One object of the present invention is to reduced the incidence of contamination of pipetter's barrel by providing a replaceable and easily cleanable barrel extension tube.

Another object of this invention is to increase the reach of the pipetter into a variety of containers and especially into deep containers holding small volumes of liquid.

Another object of the present invention is to provide a clean, sterile extension tube which assures the sterility of the vessels and the liquids involved in liquid transfers.

A further object of the present invention is to provide an extension tube which can be repeatedly washed and autoclave-sterilized to reduce the risk of microbial or other contamination of the vessels and the liquids being transferred.

Still another object of the present invention is to provide a phyical extension to a pipetting instrument without significantly reducing the accuracy or reproducibility of fluid volumes transferred in routine pipetting operations.

SUMMARY OF THE INVENTION

The invention resides in an easily removable pipetter barrel extension tube device which can be cleaned and sterilized at will. The device comprises a rigid tube having minimal internal volume that is attachable at its proximal end to any one of a variety of pipetter instruments and at its distal end to disposable liquid-dispensing tips. The air channel which defines the device's tubular geometry is formed by a conical bore concentric with the axis of the tube and by a slender conical insert plug which is removable and matches the conical bore. The insert plug functions to minimize the internal "dead" air volume of the extension tube and includes one or more longitudinal facial grooves or small raised bumps to permit unimpeded air flow along the plug. The removable design of the insert plug facilitates cleaning and subsequent reuse of the extension tube. The extension tube may be constructed with a "breakaway" distal end which, when intact, forms an air-tight connection with the disposable tips and occupies the dead air volume in the tips, thereby improving the pipetting accuracy of very small volumes of liquid of approximately 1–50 microliters. When the distal end is removed, the now shorter and wider-tipped extension tube can still be attached to the same disposable tips, but attachment occurs higher in the tip as penetration of the conical tip by the extension tube has been reduced. Subsequently, larger volumes of liquid of approximately 250 microliters can be accomodated by the tip as required when using larger capacity pipetters. The extension tube is fabricated from a durable thermoplastic which allows autoclave-sterilization and multiple reuse of the device.

The objects of the present invention are further described in the following description of the preferred embodiments taken together with the drawing, in which like reference numbers refer to like members in the figure.

DESCRIPTION OF THE PREFERRED EMBODIMENT

At the outset, the present invention is described in its broadest overall aspects with more detailed description following.

Figure 1:
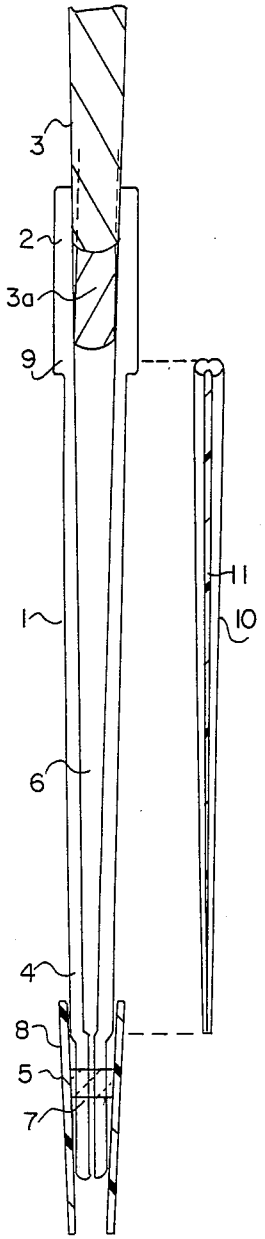
FIG. 1 is a side view in partial section of the barrel extension tube and its associated conical insert plug.

As shown in FIG. 1, the pipetter barrel extension tube 1 of the present invention is a hollow tube adapter having an upper or proximal end 2 that is female and attaches by friction-fit to various sizes of pipetter barrels 3 and 3*a*, thereby extending a barrel's length. The lower or distal end 4 of extension tube 1 is male and friction fits to a conventional, disposable 250 microliter capacity pipetter tip 5. The central bore 6 of the extension tube is of a small diameter generally ranging from 0.1–4.0 mm. On avarage, the central bore 6 is preferably of a less than 1.5 mm inner diameter so to minimize the total internal air volume of the extension tube. The outer diameter of the distal end 4 is approximately 2–5 mm and is preferably 2–3 mm, allowing the extension tube to substantially penetrate conventional disposable pipetter tips. In this way, the dead air volume in each tip is minimized and the accuracy when pipetting small liquid volumes of approximately 1–50 microliters is improved.

The lower segment at the distal end 4 of the extension tube 1 preferably incorporates a break-off or removal feature at position 8 formed by notching, scoring, otherwise weakening, or marking the plastic to allow the user to remove the lower segment 7. Without segment 7, the extension tube 1 can still be attached to conventional tips 5 but penetrates the tips less, allowing larger volumes of liquid into the tips as required for larger capacity pipetting devices. Without segment 7 the new distal end of the extension tube located at position 8 has an outer diameter of approximately 4–5 mm. For still larger capacity pipetting devices which utilize conventional conical disposable plastic tips of approximately 1.0 ml liquid capacity, the distal end 4 of the extension tube 1 is fabricated with approximately a 7 mm outer diameter.

The length of the extension tube 1 is chosen to extend the pipetter tip 5 sufficiently far into conventional est tubes, bottles, and flasks to facilitate retrieval of liquids. Although this length ranges from 1–50 cm, a 10–15 cm extension is found to be the most convenient without making the pipetting procedure noticeably awkward.

To facilitate vertical storage of many extension tubes 1 in a horizontal support rack, small support tabs or a flange 9 have been incorporated on the upper portion of the extension tube 1. The support rack (not shown) contains circular holes in which the extension tube support flange or tabs 9 rest. The storage rack also facilitates sterilization and mounting of the extension tubes.

The central bore 6 of the extension tube 1 is substantially filled by insertion of a conical insert plug 10 which functions to minimize the internal air volume of the extension tube. One or more longitudinal facial grooves 11 on the plug 10 serves to iinsure air flow up and down the extension tube. Small raised bumps (not shown) may optionally be used in place of the longitudinal facial grooves 11 to aid air flow. Removing the insert plug facilitates cleaning and subsequent reuse of the extension tube 1. Plug 10 is required because of the preferred method of injection molding used to manufacture the extension tube 1. For example, if a conventional injection molding pin (not shown) having a 2° release angle is used to form the central bore 6 of a 10 cm long extension tube, the bore 6 contains an internal air volume of approximately 340 microliters ($V_{cone}=1.047r^2h=340$ microliters when $r=1.8$ mm and $h=10$ cm). This substantial air volume comprises pipetting accuracy particularly when pipetting small volumes such as 1–50 microliters (see example 1). Therefore the excess volume in the bore 6 must be reduced after the extension tube is molded by adding a space-filler insert plug 10 to the bore. Other space fillers such as glass beads and fibers have also proven effective without attenuating air flow or comprising delivery volume accuracy. Alternatively, other methods of forming central bore 6 can be used which avoid the need for the space-filling insert plug 10. For example, molding the extension tube 1 around preformed tubing having an internal diameter of approximately 0.5–1.0 mm produces a central bore of appropriately small volume.

Air displacement-type pipetter devices rely upon a negative air pressure being transmitted to the pipetter tip 5 where a commensurate volume of liquid is accurately and reproducibly drawn into the tip 5. The negative air pressure is generated from a volumetric air displacement plunger (not shown) being raised within the barrel 3 of the pipetting device. Minimizing internal air space within the extension tube 1 should maximize the transient air pressure differential that drives the liquid displacement process and reduce the volume uncertainties caused by thermal expansion or contraction of air. To be useful, extension tube 1 must preserve accurate and reproducible pipetting of volumes of 20 microliters or less.

EXAMPLE 1

Effect of Internal Air Volume in the Extension Tube on Pipetting Accuracy

To determine the effect of increasing extension tube air volume on the accuracy of pipetting, a series of extension tubes 1 were constructed identical lengths ( 12 cm) but having increasing internal diameters. The extension tubes contained between 100 and 700 microliters air volume. Each extension tube 1 was attached to a 20 microliter capacity manual pipetter (P20 Pipetman pipetter manufactured by the Gilson Instruments Co.) . Measurement of pipetting accuracy and reproducibility were performed with the pipetter set to deliver 10.0 microliters. The accuracy of the pipetter without attaching a extension tube 1 was determined using standard polypropylene disposable tips. Delivery volumes were determined by precision weight determination of expelled water using an analytical balance. Results are shown in Table I and FIG. 2.

TABLE I

| Extension tube internal volume (microliters) | Total dead volume+ (microliters) | Volumes delivered* (microliters) | Volume Average |
|---|---|---|---|
| No extension tube | 80 | 10.1, 10.0, 10.1, 10.0 9.9, 9.9, 10.0, 10.0 | 10.0 |
| 110 | 190 | 10.0, 10.1, 10.0, 9.9, 10.0 10.1, 10.0, 10.1 | 10.0 |
| 250 | 330 | 9.7, 10.0, 9.8, 9.6, 9.7, 10.0, 9.6, 9.8 | 9.8 |
| 450 | 530 | 9.3, 9.4, 9.3, 9.2, 9.2, 9.3, 9.3, 9.4 | 9.3 |
| 700 | 780 | 7.5, 8.5, 8.8, 8.7, 8.7, 9.0, | 8.5 |

TABLE I-continued

| Extension tube internal volume (microliters) | Total dead volume+ (microliters) | Volumes delivered* (microliters) | Volume Average |
|---|---|---|---|
| | | 8.3, 8.4 | |

+Total volume of extension tube plus additional 80 microliter air volume in disposable tip.
*Volumes delivered were determined using a Gilson "P20 Pipetman" pipetter. Note that with no extension tube, the tip alone had an air volume of 80 microliters.

Figure 2:
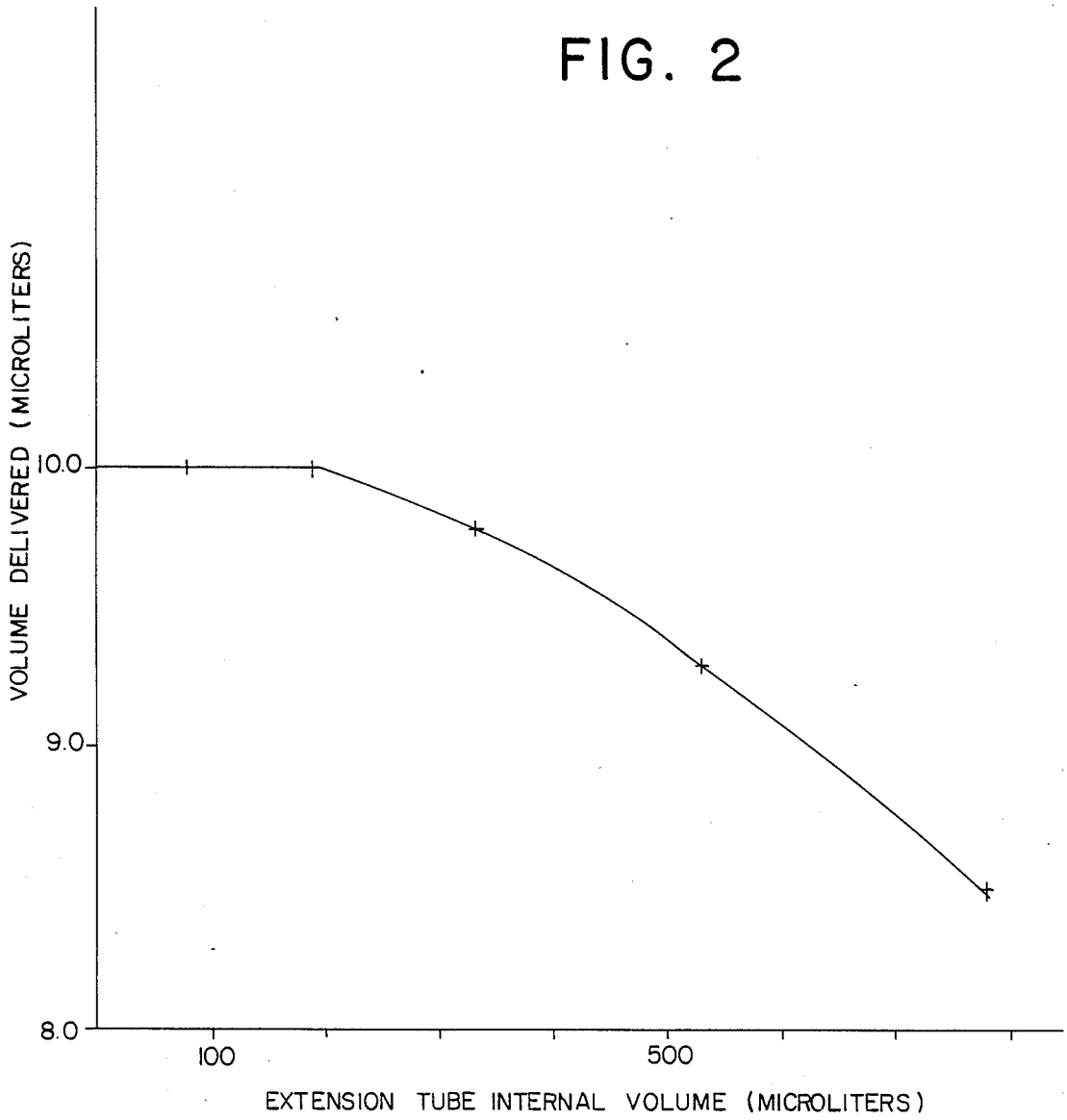
FIG. 2 is a graphical representation of the actual volume of liquid delivered from a pipetter set to deliver 10.0 microliters when extension tubes having various internal volumes are attached between the pipetter and the disposable tip.

The data in Table I illustrates the importance of keeping the internal volume of the extension tube to a minimum. When the average volume delivered is plotted against the extension tube internal volume, as shown in FIG. 2, the resulting slope-intercept indicates that the air volume of the extension tube should not exceed 150 microliters and should preferably be 100 microliters or less (if pipetting in the ten microliter dispensing range is to remain within ±0.1 microliters) . With an extension tube air volume of 250 microliters, volume dispensing "short-falls" of 0.2–0.4 microliters become evident, as shown in Table I. The data also shows that inaccuracies and volume variabilities become more severe as the extension tube air volume is further increased.

Several extension tubes having lengths of 5 cm or less have been constructed to provide a sample sterile air filter and liquid barrier between the disposable pipetter tip 5 and the pipetter. These devices are designed to assure that a sterile liquid remains sterile when delivered from the pipetter tip 5. A cotton or glass wool plug 12 in the device prevents particulate material and other contaminating material in the pipetter barrel from descending into the sterile pipetter tip 5. Furthermore, the present invention blocks chemical or radio-chemical contamination of the pipetter barrel interior if and when liquids in the tip 5 accidentally projected upward towards the barrel 3.

The extension tube 1 is preferably fabricated from plastic, and may be constructed to be a disposable or a reusable device. Polyethylene are typical plastics appropriate for manufacturing disposable barrel extension tubes. Polypropylene, polycarbonate, polymethylpentene, polysulfone and polyetherimide are typical plastics appropriate for fabricating reusable extension tubes 1. Reusable extension tubes 1 may be washed and subsequently sterilized by steam-autoclaving at 120° C. Polysulfone and polyetherimide extension tubes may additionally be dry-heat sterilized at 150°–180° C.

Methods of manufacturing the extension tube 1 of the present invention include injection, extrusion and blow-molding. Injection molding is preferred but a combination of these methods may also be utilized. For example, one can extrude the major portion of the extension tube and mold one or both ends. The multiple sections may then be ultrasonically welded together, as is commonly the practice with commerical disposable polystyrene serological pipets.

In summary, the extension tube 1 of the present invention provides a multiplicity of uses. The extension tube 1 extends the length of the pipetter barrel 3 to allow access to liquids in bottles, flasks and test tubes. As a sterile device, the extension tube 1 assures the sterility of the solution being transferred as well as the sterility of containers being contacted during the transfer. Additionally, the extension tube 1 acts as physical buffer barrier between the disposable tip 5 and the pipetter barrel to prevent accidental comtamination of the inside and outside of the barrel. This function is particularly inpórtant when pipetting corrosive or radioactive liquids. Such contamination may occur when using conventional pipettter barrels through aerosol formation or through sudden upward displacement of liquid droplets.

What is claimed is:

1. A freely attachable pipetter barrel air conduit extension tube comprising:

a standard pipetter tip;

a small bore rigid tube having friction-mediated connecting means on each end;

a first end being conical and male and capable of detachably connecting to said standard pipetter tip;

a second end being female and capable of detachably connecting to a variety of pipetter barrels;

a substantially non-compressible stationary space-filling means located within the bore of said barrel extension tube for reducing the internal air volume of said tube, said space-filling means being formed to have an outer surface contour which cooperates with said tube to define at least one continuous air path along the entire length of said tube, said continuous air path being of a volume which is less than the fluid capacity of the pipetter tip; and a detachable segment at the first end of said extension tube, whereby removal of said segment, while still allowing connection of said first end to said standard pipetter tip, reduces the penetration of said first end into said standard pipetter tip.

2. A freely attachable accessory pipetter barrel air conduit extension tube comprising:

a standard pipetter tip;

a small bore rigid tube having friction-mediated connecting means on each end;

a first end being conical and male and capable of detachably connecting to said standard pipetter tip;

a second end being female and capable of connecting to a variety of pipetter barrels;

and a substantially non-compressible stationary space-filling means located within the bore of said barrel extension tube for reducing the internal air volume of said tube, said space-filling means being formed to have an outer surface contour which cooperates with said tube to define at least one continuous air path along the entire length of said tube, said continuous air path being of a volume which is less than the fluid capacity of the pipetter tip.

3. A barrel extension tube according to claim 2 wherein the space-filling means is a slender plug approximately matching but not blocking the bore of said tube.

4. A barrel extension tube according to claim 2 wherein the overall length of said tube is between 2 and 50 cm.

5. A barrel extension tube according to claim 2 wherein the overall length of said tube is approximately 10 cm.

6. A barrel extension tube according to claim 2 wherein the internal volume within said bore of said tube is less than 150 microliters.

7. A barrel extension tube according to claim 3 wherein said bore contains filtering means to allow air flow while blocking passage of contaminants through said tube.

8. A barrel extension tube according to claim 7 wherein the filtering means comprises a cotton plug.

9. A barrel extension tube according to claim 7 wherein the filtering means comprises a glass wool plug.

10. A barrel extension tube according to claim 2 wherein said tube is sterile.

11. A barrel extension tube according to claim 2 wherein said tube is fabricated from one or more thermoplastics comprising polystyrene, polyethylene, polypropylene, polycarbonate, polymethylpentene, polysulfone and polyetherimide.

12. The pipetter barrel extension tube as set forth in claim 3 wherein said air path volume is less than one-half the fluid capacity of the pipetter tip.

13. An improved pipetter instrument, including a pipetter barrel and pipetter tip, wherein the improvement comprises:

a small bore rigid extension tube having friction-mediated connecting means on each end;

a first end being conical and male and capable of detachably connecting to the pipetter tip;

a second end being female and capable of detachably connecting to the pipetter barrel;

a substantially non-compressible stationary space-filling means located within the bore of said extension tube for reducing the internal air volume of said tube, said space-filling means being formed to have an outer surface contour which cooperates with said tube to define at least one continuous air path along the entire length of said tube, said continuous air path being of a volume which is less than the fluid capacity of the pipetter tip; and a detachable segment at the first end of said extension tube, whereby removal of said segment, while still allowing connection of said first end to said pipetter tip, reduced the penetration of said first end into said pipetter tip.

14. An improved pipetter instrument, including a pipetter barrel and pipetter tip, wherein the improvement comprises:

a small bore rigid extension tube having friction-mediated connecting means on each end;

a firse end being conical and male and capable of detachably connecting to said pipetter tip;

a second end being female and capable of connecting to said pipetter barrel;

and a substantially non-compressible stationary space-filling means located within the bore of said extension tube for reducing the internal air volume of said tube, said space-filling means being formed to have an outer surface contour which cooperates with said tube to define at least one continuous air path along the entire length of said tube, said continuous air path being of a volume which is less than the fluid capacity of the pipetter tip.

15. A method for extending a pipetter barrel comprising:

providing a small bore rigid tube having friction-mediated connecting means on both ends, a first end of said tube being conical end male and a second end of said tube being female;

inserting a substantially non-compressible space-filling means into the bore of said tube, said space-filling means being formed to have an outer surface contour which cooperates with said tube to define at least one continuous air path along the entire length of said tube;

connecting a standard pipetter tip to said first end of said tube by inserting said first end into said pipetter tip, said pipetter tip having a fluid capacity greater than the volume of said at least one continuous air path; and connecting said rigid tube to the pipetter barrel by inserting said pipetter barrel into said second end of said rigid tube.

16. The method as set forth in claim 15 wherein small bore rigid tube is provided with a detachable segment and wherein said method further comprises the step of:

removing said detachable segment to reduce the penetration of said first end into said standard pipetter tip while still allowing connection of said first end to said standard pipetter tip.

* * * * *